United States Patent [19]

Riccardo et al.

[11] Patent Number: 4,589,811

[45] Date of Patent: May 20, 1986

[54] DEVICE FOR AUTOMATICALLY SUPPLYING REELS OF WRAPPING MATERIAL TO A UTILIZER MACHINE

[75] Inventors: Mattei Riccardo, Bologna; Bruno Belvederi, S. Martino di Monte S. Pietro, both of Italy

[73] Assignee: G.D. Societa per Azioni, Bologna, Italy

[21] Appl. No.: 683,266

[22] Filed: Dec. 18, 1984

[30] Foreign Application Priority Data

Jan. 25, 1984 [IT] Italy ..... 3320 A/84

[51] Int. Cl.[4] ..... B65H 1/00

[52] U.S. Cl. ..... 414/224; 193/35 R; 198/463.6; 198/468.6; 242/58.6; 414/27; 414/276; 414/330; 414/911

[58] Field of Search ..... 414/27, 222, 224, 225, 414/330, 276, 684, 911, 908; 198/463.6, 468.6, 468.9, 487.1; 193/35 R, 35 A, 40, 42; 242/58.6, 79, 84

[56] References Cited

U.S. PATENT DOCUMENTS

| | | | |
|---|---|---|---|
| 1,382,396 | 6/1921 | Szymanske . | |
| 2,649,231 | 8/1953 | Ferguson et al. | 198/419 X |
| 3,844,400 | 10/1974 | Dehne | 104/252 X |
| 4,441,662 | 4/1984 | Seragnoli | 414/224 X |

FOREIGN PATENT DOCUMENTS

| | | | |
|---|---|---|---|
| 1549885 | 8/1979 | United Kingdom | 242/79 |
| 2093439 | 9/1982 | United Kingdom . | |
| 770597 | 10/1980 | U.S.S.R. | 242/79 |

*Primary Examiner*—Donald W. Underwood

[57] ABSTRACT

An automatic device is described for supplying reels of wrapping material to a utilizer machine, in which there are provided a magazine, disposed in a position adjacent to the machine, for a plurality of reserve reels, and a reel carrier for transferring the individual reels to said machine. The magazine comprises a shaft for supporting the reels through their tubular spindle, and at least two support elements for the shaft which can be removed one at a time from this latter under the control of respective mutually independent operating means, in such a manner as to enable the reels to slide towards the reel carrier.

4 Claims, 3 Drawing Figures

DEVICE FOR AUTOMATICALLY SUPPLYING REELS OF WRAPPING MATERIAL TO A UTILIZER MACHINE

BACKGROUND OF THE INVENTION

This invention relates to a device for automatically supplying reels of wrapping material to a utiliser machine. From British Patent Application No. 2,093,439, a device of the aforesaid type is known in which automatic transfer means take-up the reels individually from a reserve stock in order to transfer them to a utilisation position, in which means forming part of the utiliser machine unwind from them a web intended for a wrapping operation.

The operation of the transfer means takes place under the control of a control device sensitive to the depletion of the reel which is being unwound in the utilisation position. In the reserve stock, the reels, which are disposed side-by-side, rest by way of their respective outer cylindrical surfaces on an inclined conveyor constituted by the upper branches of three endless belts disposed in such a manner as to define a cradle arranged to prevent the reels undergoing movement transverse to their respective axes. The reels are loaded manually or automatically on the inclined conveyor, and descend stepwise along it as they become individually taken-up by the transfer means at the lower end of the magazine.

The transfer means are constituted by a carriage, mobile with to-and-fro movement between the reel take-up position and the utilisation position.

On the carriage there is pivoted an arm, sized in such a manner that on rotation about its pivot, one of its free ends becomes inserted into the tubular spindle of the reel waiting in the take-up position.

The described device has the drawback of being sized for a determined reel diameter.

When it is required to use reels of a diameter different from this value, it is necessary to replace or at least adjust said arm, so as to enable it to insert its free end into the tubular spindles of the reels.

A further drawback of the described device derives from the fact that reels inside the magazine lie on the belts of the inclined conveyor during their transfer from the loading position to the take-up position, with consequent deterioration and soiling of their most outer turns.

SUMMARY OF THE INVENTION

The object of the present invention is to obviate the aforesaid drawbacks by providing an automatic supply device able to take-up the reels from the magazine independently of their diameter and to transfer them from the loading position to the take-up position without the minimum damage.

The said object is attained according to the present invention by a device for automatically supplying reels of wrapping material to a utiliser machine, the device comprising a magazine for a plurality of reels comprising a tubular winding spindle and constituting a reserve stock disposed in a position adjacent to said machine, and transfer means for transferring said reels in succession from said magazine to said machine, characterised in that said magazine comprises a shaft for supporting said reels through said tubular spindles, and extending from a position in which said reels are loaded on to a first end thereof and a position in which transfer means; at least two support elements for said shaft, comprising gripper means which can be removed from this latter and which define along said shaft a plurality of partial magazines; means for causing each of said gripper means to withdraw from and reapproach said shaft; and mutually independent operating means for each of said withdrawal and reapproach means, controlled by means for monitoring the state of filling of individual partial magazines.

BRIEF DESCRIPTION OF THE DRAWINGS

The present invention is described hereinafter by way of non-limiting example with reference to the accompanying drawings in which.

DESCRIPTION OF THE PREFERRED EMBOIDMENTS

Figure 1:
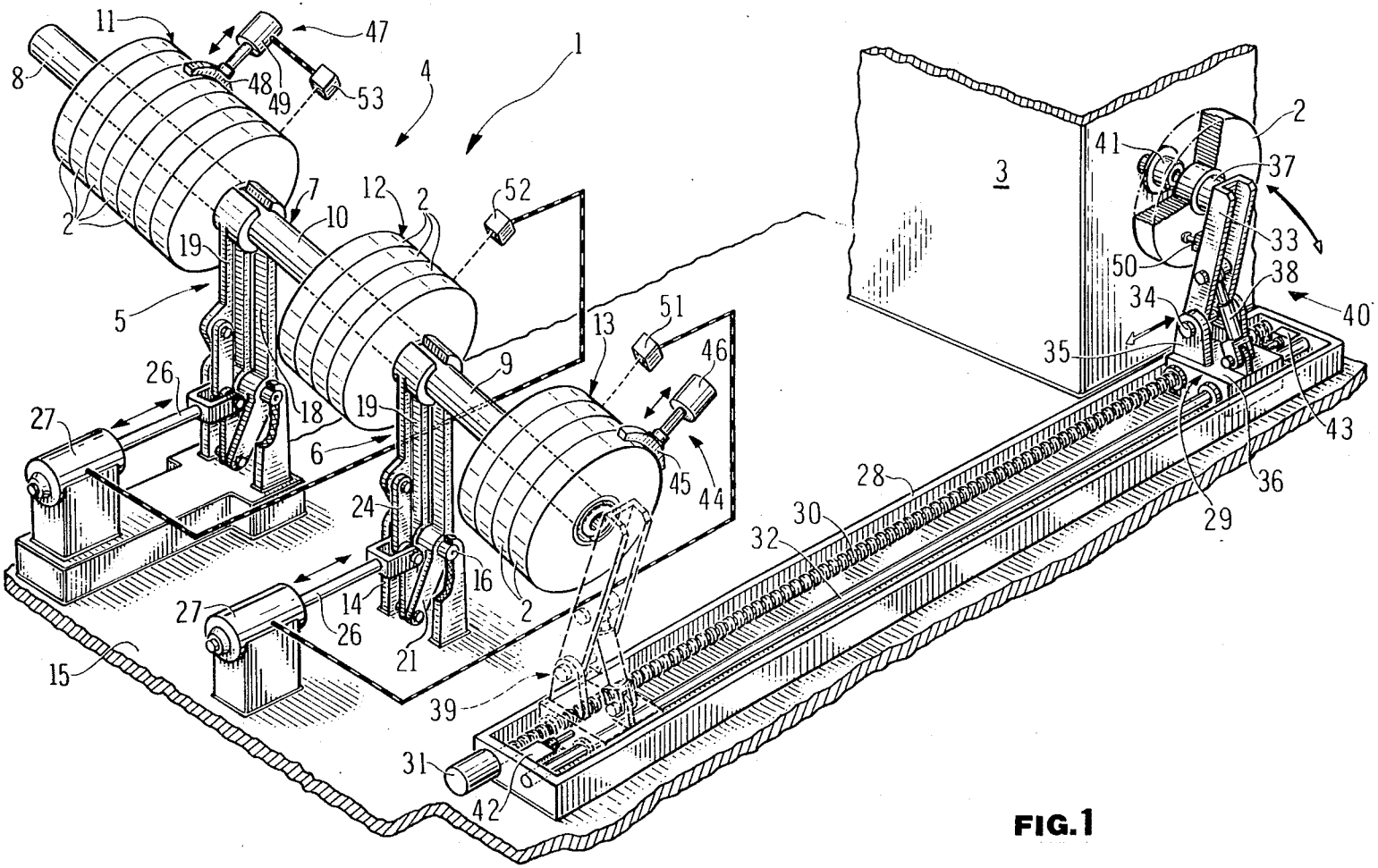
FIG. 1 is a diagrammatic perspective view of a reel supply device constructed in accordance with the present invention.

FIG. 1 shows a device 1 for automatically supplying paper reels 2 to a utiliser machine 3, in particular a cigarette packaging machine.

The device 1 comprises a magazine 4 for reserve reels 2, comprising two support elements 5 and 6 for a shaft 7 arranged to support a plurality of reels 2 in an axially slidable manner through their tubular spindles.

The shaft 7 is disposed slightly inclined to the horizontal, is supported by the elements 5 and 6 at two spaced-apart intermediate zones.

In this manner, the respectively upper and lower end portions 8 and 9 of the shaft 7, and a portion 10 thereof lying between the elements 5 and 6, can support three respective groups 11, 12 and 13 of reels 2 constituting three partial magazines.

The support elements 5 and 6 are substantially equal to each other, and consequently in the description given hereinafter only one will be descrited, the same reference numerals being given to corresponding parts of each.

The elements 5 (see FIG. 2 in particular) comprises an upright 14 fixed to a horizontal baseplate 15 supporting an axle 16 parallel to the shaft 7, and on which the upper ends of two upwardly projecting arms 18 and 19 are pivoted.

The arms 18 and 19 are provided upperly with respective semi-annular gripper means 20 arranged to adhere by combined action to a peripheral portion of the shaft 7.

Figure 2:
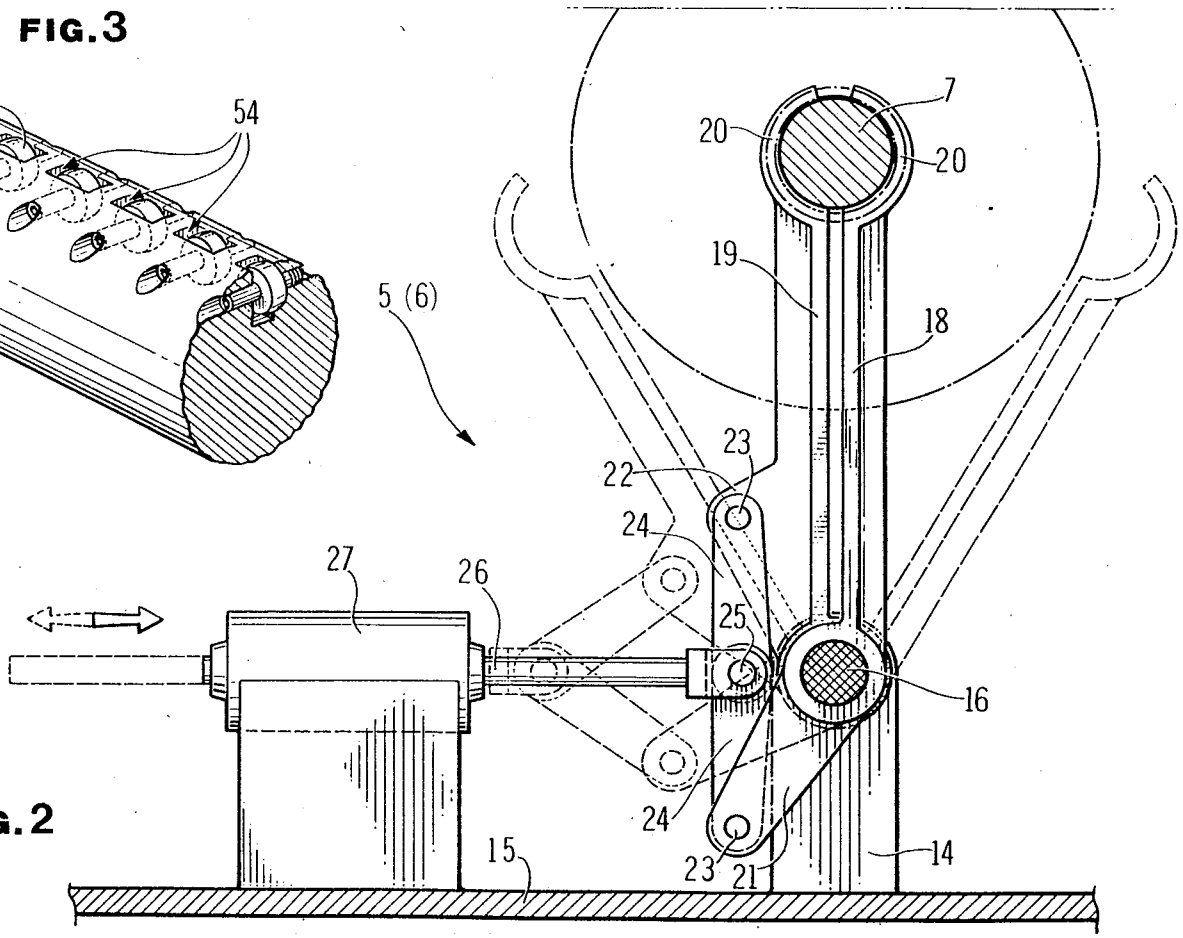
FIG. 2 shows a detail of FIG. 1 to an enlarged scale.

With the lower end of the arm 18 there is rigid an appendix 21 which projects downards and to the left in FIG. 2, and an appendix 22 lying above the appendix 21 is fixed to a portion of the arm 19 lying immediately below the gripper means 20.

By means of a pivot 23, there is rotatably connected to the free ends of each of the appendices 21 and 22 one end of a bar 24, the other end of which is connected by means of a pivot 25 to one end of a horizontal shaft 26, which is normal to the shaft 7 and constitutes the output of a linear actuator or operating means 27 of known type.

During the operation of the actuator 27, the shaft 26 is able to move axially in both directions, to cause the gripper means 20 to undergo mutual withdrawal or approach according to whether it moves away from the upright 14 or towards it.

The pivots 23 and 25 and the bars 24 constitute overall a toggle mechanism for causing the gripper means 20 to withdraw from and reapproach the shaft 7 under the action of the actuator 27.

Below the lower end of the shaft 7 and in a position adjacent to the magazine 4, the plate 15 supports an elongated box 27, the axis of which extends in a substantially horizontal direction perpendicular to the axis of the shaft 7.

Inside the box 28 there is mounted in a mobile manner a transfer means comprising a carriage 29, the movement of which is controlled by the rotation of a screw 30 connected to a reversible motor 31 and extending axially along said box 28. The carriage 29 is also slidably coupled to a guide rod 32 extending inside the box 28 parallel to the screw 30. By means of a pivot 34 parallel to the screw 30, a substantially vertical arm 33 has its lower end pivoted on a support 35 fixed to an upper wall 36 of the carriage 29. Said arm 33 is provided upperly with a tubular element 37 for holding the reels 2 through their tubular spindle, and is connected in its middle zone to a linear actuator 38 rigid with the wall 36. On rotation of the screw 30 the carriage 28 is mobile in both directions along the rod 32 between a position 39 in which the reels 2 are taken-up from the magazine 4, at which the holding element 37 faces the lower end of the shaft 7, and a release position 40 for the reels 2, at which the holding element 37 faces a support element 41 for said reels 2 which forms part of the machine 3.

Two sensors 42 and 43, disposed in the box 28 at that end thereof which lies below the shaft 7 and that end thereof adjacent to the machine 3 respectively, are able to sense the presence of the carriage 29 at one or other of its end-of-travel positions.

In a position corresponding with the lower end of the shaft 7, the magazine 4 is provided with a stop device 44 comprising a brake pad 45 disposed facing the periphery of the reel 2 which is waiting in the take-up position, and is mobile in a direction radial to this latter reel under the action of a linear actuator 46.

A second stop device 47, entirely analogous to the device 44 and comprising a brake pad 48 and a linear actuator 49, is disposed facing one of the reels 2 of the group 11, this reel being defined more fully hereinafter. In use, the magazine 4 is loaded with the reels 2 manually before plant start-up, so that the magazine 4 assumes the configuration shown in FIG. 1.

After a reel 2 has been disposed on the tubular element 37 and a sensor 50 supported by the arm 33 has sensed its presence, said sensor 50, in combination with the sensor 42 which senses the presence of the carriage 29 in front of the shaft 7, determines the activation of the actuator 46, which causes the pad 45 to lock the next reel 2 on to the shaft 7, and also start the motor 31.

On being started, the motor 31 by means of the screw 30, causes the carriage 29 to move towards the machine 3. This movement terminates when the carriage 29 reaches the sensor 43, with the tubular element 37 in a position in which it lies substantially facing the support element 41. The sensor 43 also determines the operation of the actuator 38, which causes the arm 33 to rotate about its pivot so as to move the reel 2 on to the support element 41.

The actuator 38 then withdraws the arm 33 from the machine 3, and the motor 31, now being made to rotate in the opposite direction to that by which the reels 2 were fed to the machine 3, causes the carriage 29 to return to the position 39. The stop device 44, activated by said sensors 42 and 50, withdraws its pad 45 from the shaft 7, to enable the reels 2 of the group 13 to slide towards the tubular element 37 and to enable the most advanced of these reels to become disposed thereon.

The operations involved in transferring the reels 2 to the machine 3 take place in the described manner until a sensor or checking means 51 arranged to determine the number of reels 2 which make up the group 13 senses that the group 13 now comprises a predetermined minimum number of reels 2.

The actuator 27 then causes the gripper means 20 of the support element 6 to diverge, and the group 12 of reels 2 slides on the shaft 7 until it reaches the reels 2 of the group 13. The gripper means 20 of the support element 6 then reconverge under the control of the sensor 51, when this senses the arrival of new reels 2 on the portion 9 of the shaft 7. A sensor or checking means 52 for sensing the presence of reels 2 on the portion 10 of the shaft 7 then actuates the actuator 27 associated with the support element 5, to cause the gripper means 20 thereof to diverge.

This diverging action is preceded by the activation of the actuator 49 by a sensor 53 sensing the presence of reels 2 between the stop device 47 and the support element 5, to cause the brake pad 48 to move against a reel 2 so as to prevent an excessive number of reels 2 of the group 11 moving on to the portion 10 of the shaft 7.

The sensor 52 then causes the gripper means 20 of the support element 5 to undergo mutual reapproach, and the sensor 53 causes the pad 48 to withdraw from the reels 2. The group 11 can then be completed by placing other reels 2 on the shaft 7 by way of its upper end.

Figure 3:
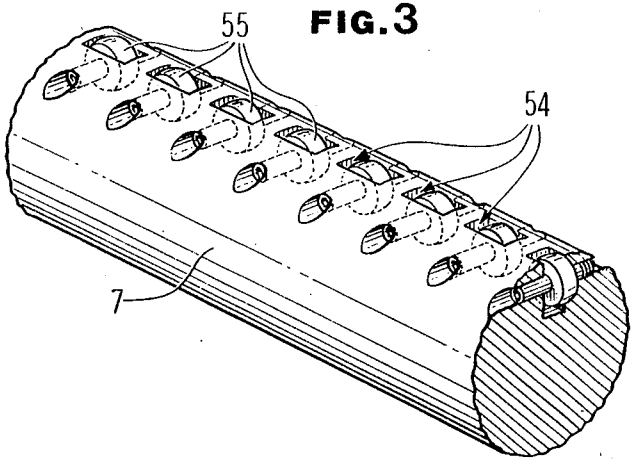
FIG. 3 shows a modification of a detail of the preceding figures to an enlarged scale.

As shown in FIG. 3, in order to facilitate the sliding of the reels 2 along the shaft 7, the upper surface of this latter can comprise a plurality of axial slots 54 in which respective idle rollers 15 are housed with their axes normal to the axis of the shaft 7. Said rollers 55, by partially projecting from the shaft 7, constitute low-friction slide means for the reels 2.

What I claim is:

1. A device for automatically supplying reels of wrapping material to an utiliser machine comprising: a magazine for a plurality of reels comprising tubular winding spindles and constituting a reserve stock disposed in a position adjacent to said machine; transfer means for transferring said reels in succession from said magazine to said machine; a shaft in said magazine for supporting said reals through said tubular spindles and extending from a position in which said reels are loaded on to a first end thereof and a position in which said reels are taken-up from the second end thereof by said transfer means; at least two support elements for said shaft comprising gripper means which can be removed from this latter and which define along said shaft a plurality of partial magazines; means for causing each of said gripper means to withdraw from and reapproach said shaft; and mutually independent operating means for each of said withdrawal and reapproach means controlled by means for monitoring the state of filling of individual partial magazines.

2. A device as claimed in claim 1, wherein said shaft is inclined downwards from said loading position to said take-up position, and is provided on its cylindrical surface with slide means engageable by the tubular spindles of said reels.

3. A device as claimed in claim 1, wherein each said support element comprises two gripper means for said support shaft which can oppose each other and are rigid with respective arms pivoted on a common axle, said arms being connected by a toggle mechanism to an output shaft of a said operating means and which is normal to said support shaft and can be driven with axial reciprocating motion.

4. A device as claimed in claim 2, wherein each said support element comprises two gripper means for said support shaft which can oppose each other and are rigid with respective arms pivoted on a common axle, said arms being connected by a toggle mechanism to an output shaft of a said operating means and which is normal to said support shaft and can be driven with axial reciprocating motion.

* * * * *